US008552920B2

(12) United States Patent
Chung et al.

(10) Patent No.: US 8,552,920 B2
(45) Date of Patent: Oct. 8, 2013

(54) PATCH ANTENNA SYNCHRONOUSLY GENERATING LINEARLY POLARIZED WAVE AND CIRCULARLY POLARIZED WAVE AND GENERATING METHOD THEREOF

(75) Inventors: Tae Inn Chung, Pohang (KR); Byung-Nam Kim, Bucheon (KR); Tae-Hwan Yoo, Seoul (KR); Young-Hun Park, Cheongju (KR)

(73) Assignees: Hyundai Motor Company, Seoul (KR); ACE Technologies Corporation, Seoul (KR)

( * ) Notice: Subject to any disclaimer, the term of this patent is extended or adjusted under 35 U.S.C. 154(b) by 391 days.

(21) Appl. No.: 12/954,361

(22) Filed: Nov. 24, 2010

(65) Prior Publication Data

US 2012/0050126 A1 Mar. 1, 2012

(30) Foreign Application Priority Data

Aug. 31, 2010 (KR) ..... 10-2010-0085071

(51) Int. Cl.
*H01Q 19/10* (2006.01)

(52) U.S. Cl.
USPC ..... 343/834

(58) Field of Classification Search
USPC ..... 343/700 MS, 702, 711, 771, 834
See application file for complete search history.

(56) References Cited

U.S. PATENT DOCUMENTS

| | | | | |
|---|---|---|---|---|
| 5,293,171 | A * | 3/1994 | Cherrette | 343/700 MS |
| 7,310,065 | B2 * | 12/2007 | Anguera Pros et al. | 343/700 MS |
| 7,471,248 | B2 * | 12/2008 | Popugaev et al. | 343/700 MS |
| 7,868,843 | B2 * | 1/2011 | Borau et al. | 343/844 |
| 2003/0067410 | A1 * | 4/2003 | Puzella et al. | 343/700 MS |
| 2005/0146477 | A1 * | 7/2005 | Kelly et al. | 343/771 |
| 2009/0058731 | A1 * | 3/2009 | Geary et al. | 343/700 MS |

FOREIGN PATENT DOCUMENTS

| | | |
|---|---|---|
| JP | 07-212125 | 8/1995 |
| JP | 07-240621 | 9/1995 |
| JP | 07-336132 | 12/1995 |
| JP | 09-284031 | 10/1997 |
| JP | 2002-043832 | 2/2002 |
| JP | 2002-118420 | 4/2002 |
| KR | 10-2005-0075966 A | 7/2005 |
| KR | 10-2007-0034924 A | 3/2007 |

* cited by examiner

*Primary Examiner* — Huedung Mancuso
(74) *Attorney, Agent, or Firm* — Edwards Wildman Palmer LLP; Peter F. Corless

(57) ABSTRACT

A patch antenna synchronously generating a circularly polarized wave and a linearly polarized wave comprises a first radiator radiating a circularly polarized wave with respect to an antenna signal, a first substrate provided at a part or the whole of the rear surface of the first radiator, a second radiator provided at a part or the whole of the rear surface of the first substrate and radiating a linearly polarized wave with respect to the antenna signal, and a second substrate provided at a part or the whole of the rear surface of the second radiator.

14 Claims, 5 Drawing Sheets

PATCH ANTENNA SYNCHRONOUSLY GENERATING LINEARLY POLARIZED WAVE AND CIRCULARLY POLARIZED WAVE AND GENERATING METHOD THEREOF

CROSS-REFERENCES TO RELATED APPLICATIONS

This application claims under 35 U.S.C. §119(a) the benefit of Korean Patent Application No. 10-2010-0085071, filed on Aug. 31, 2010, which is incorporated by reference in its entirety.

BACKGROUND OF THE INVENTION

1. Field of the Invention

The present invention relates to a patch antenna synchronously generating a circularly polarized wave and a linearly polarized wave and a generating method thereof.

2. Description of the Related Art

In general, a patch antenna includes a dielectric plate. One surface of the dielectric plate is used as a ground plate, and another surface thereof configures a circuit as a strip line. Since the patch antenna can be manufactured by a printed board, it is advantageous in that it is easily manufactured, suitable for mass production, and firm, and has a low height. Because the antenna may easily engage with integrated circuit (IC) devices, it is widely used in small devices of millimeter band such as a portable phone.

The patch antenna can be divided into a linearly polarized wave antenna and a circularly polarized wave antenna.

FIG. 1 is a graph illustrating a moving direction of a linearly polarized wave. FIG. 2 is a graph illustrating a moving direction of a circularly polarized wave.

Here, the linearly polarized wave includes a vertical polarized wave having an electric field perpendicular to the ground and a horizontal polarized wave having an electric field horizontal to the ground, A circularly polarized wave is a polarized wave that has an electric field rotating in a string shape and moving along an axis.

When a circularly polarized antenna generating a circularly polarized wave communicates with a linear polarized antenna generating a linearly polarized wave, −3 dB loss theoretically occurs between the two antennas. Therefore, there is a need for a patch antenna synchronously generating a circularly polarized wave and a linearly polarized wave to communicate with a circularly polarized antenna or a linearly polarized antenna without loss.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in view of the above problems, and provides a patch antenna capable of performing data communication with a different antenna (circularly polarized antenna or linearly polarized antenna) without loss.

An aspect of the present invention provides a patch antenna synchronously generating a linearly polarized wave and a circularly polarized wave. The patch antenna includes: a first radiator radiating a circularly polarized wave with respect to an antenna signal; a first substrate provided at a part or the whole of the rear surface of the first radiator; a second radiator provided at a part or the whole of the rear surface of the first substrate and radiating a linearly polarized wave with respect to the antenna signal; and a second substrate provided at a part or the whole of the rear surface of the second radiator. The patch antenna may further comprise an auxiliary radiator provided at a part or the whole of the front surface of the first substrate.

Another aspect of the present invention provides a method for synchronously generating a linearly polarized wave and a circularly polarized wave by the above-described patch antenna. The method includes: (a) radiating a circularly polarized wave with respect to an antenna signal by a first radiator provided at a part or the whole of the front surface of a first substrate; and (b) radiating a linearly polarized wave with respect to the antenna signal by a second radiator provided at a part or the whole of the front surface of a second substrate. The method may further include: (c) reflecting a circularly polarized wave radiated from the first radiator by a reflection plate provided at a part or the whole of the rear surface of the second substrate; and (d) radiating the linearly polarized wave by the reflection plate.

With the patch antennas and the methods according to the present invention, as detailed below, both of radiating characteristics of the circularly polarized wave and the linearly polarized wave can be stabilized, resonant frequency characteristics of the first radiator can be easily controlled, and data communication with a different antenna (circularly polarized antenna or linearly polarized antenna) can be performed without the problem of loss associated with the prior art, among others.

BRIEF DESCRIPTION OF THE DRAWINGS

The objects, features and advantages of the present invention will be more apparent from the following detailed description in conjunction with the accompanying drawings, in which.

DETAILED DESCRIPTION OF EXEMPLARY EMBODIMENTS

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Figure 1:
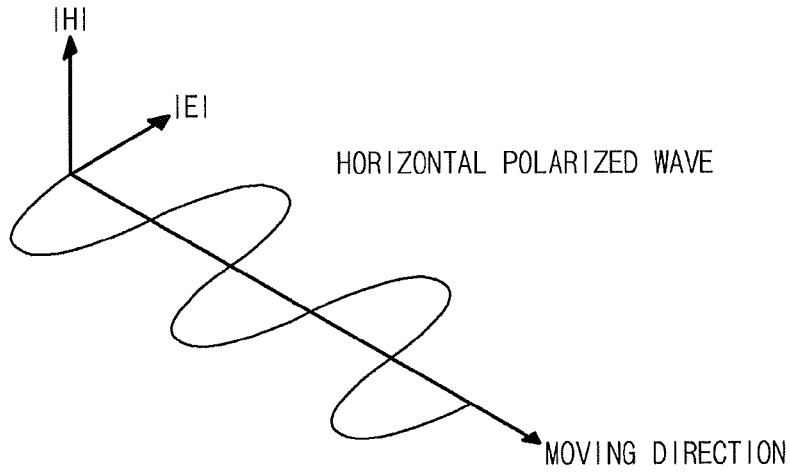
FIG. 1 is a graph illustrating a moving direction of a linearly polarized wave.
Figure 1:
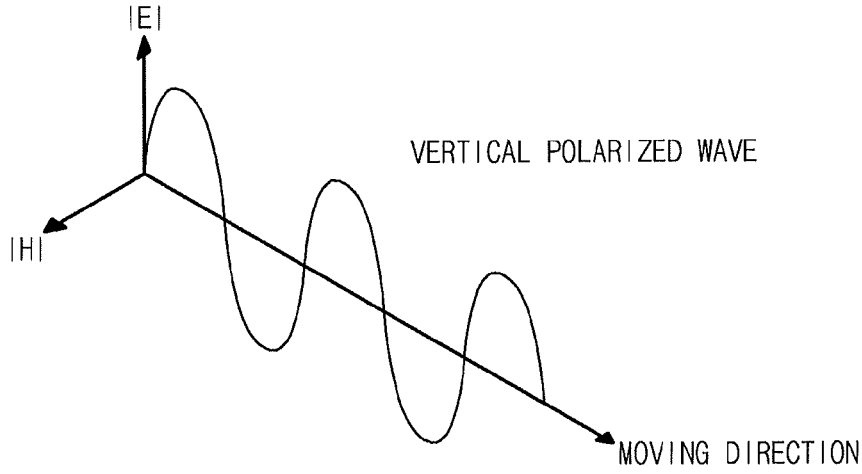
Figure 2:
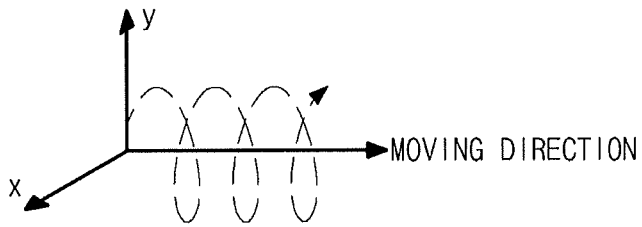
FIG. 2 is a graph illustrating a moving direction of a circularly polarized wave.
Figure 3:
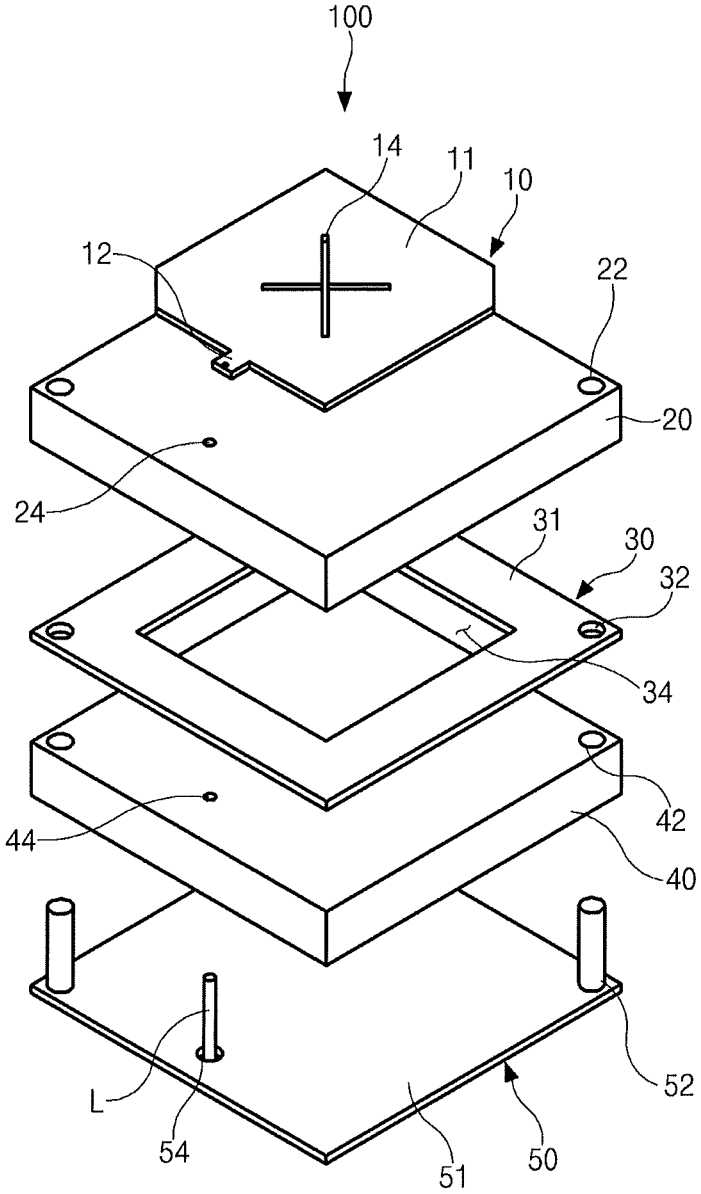
FIG. 3 is a perspective view illustrating the configuration of a path antenna synchronously generating a linearly polarized wave and a circularly polarized wave according to an embodiment of the present invention.
Figure 4:
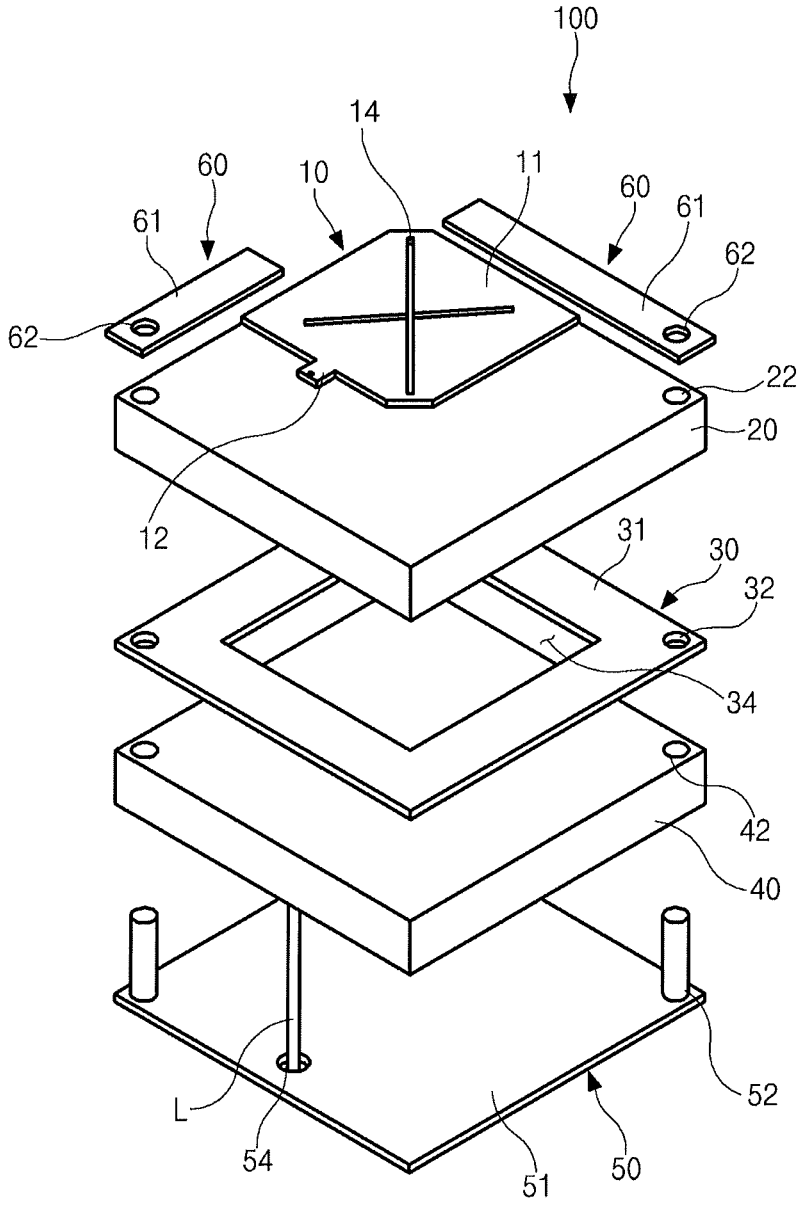
FIG. 4 is a perspective view illustrating the configuration of a path antenna synchronously generating a linearly polarized wave and a circularly polarized wave, which further includes an auxiliary radiator, according to an embodiment of the present invention.

FIG. 3 is a perspective view illustrating the configuration of a path antenna 100 synchronously generating a linearly polarized wave and a circularly polarized wave according to an embodiment of the present invention. FIG. 4 is a perspective view illustrating a configuration of a path antenna 100 synchronously generating a linearly polarized wave and a circularly polarized wave, which further includes an auxiliary radiator 60, according to an embodiment of the present invention.

The path antenna 100 synchronously generating a linearly polarized wave and a circularly polarized wave according to an embodiment of the present invention includes a first radiator 10, a first substrate 20, a second radiator 30, a second substrate 40, and a reflection plate 50. It may further include an auxiliary radiator 60 and a power supply line L.

The first radiator 10 has a rectangular panel shape, and radiates a circularly polarized wave. The first substrate 10 is provided at a part or the whole of the rear surface of the first radiator 10 and supports the first radiator 10.

The second radiator 30 is provided at a part or the whole of the rear surface of the first substrate 20 so as not to be overlapped with the first radiator 10 on a plane. The second radiator 30 radiates a linearly polarized wave. The second substrate 40 is provided at a part or the whole of the rear surface of the second radiator 30.

The reflection plate 50 is provided at a part or the whole of the rear surface of the second substrate 40, and reflects the circularly polarized wave radiated from the first radiator 10. Further, the reflection plate 50, with the second radiator 30, radiates the linearly polarized wave.

The auxiliary radiator 60, with the second radiator 30 and the reflection plate 50, radiates the linearly polarized wave.

The power supply line L penetrates the reflection plate 50, the second substrate 40, and the first substrate 20 without electric connection therewith to supply an antenna signal to the first radiator 10.

Hereinafter, the path antenna 100 synchronously generating a linearly polarized wave and a circularly polarized wave according to an embodiment of the present invention will be described in detail.

First Radiator 10

With reference to FIGS. 3 and 4, the first radiator 10 includes a circularly polarized wave radiating module 11, a signal receiving module 12, and an X groove 14.

The circularly polarized wave radiating module 11 is provided to have a rectangular panel shape. Diagonally facing corners are cut by a predetermined angle in the circularly polarized wave radiating module 11. The circularly polarized wave radiating module 11 converts an antenna signal received through a power supply module, which is described below, into a circularly polarized wave. Further, the circularly polarized wave radiating module 11 radiates the converted circularly polarized wave to an exterior. Here, the circularly polarized wave radiating module 11 radiates the circularly polarized wave in a positive (+) pole and a negative (−) pole with a time period of 0.5λ. A part or the whole of the rear surface of the circularly polarized wave radiating module 11 comes in contact with a part or the whole of the front surface of the first substrate 20, which is described below.

The signal receiving module 12 is provided at one side of the circularly polarized wave radiating module 11. The signal receiving module 12 receives an antenna signal from an external antenna signal generator through a power supply line L. Further, the signal receiving module 12 transfers the received antenna signal to the circularly polarized wave radiating module 11.

The X groove 14 is provided by intersecting two slots of different lengths with a predetermined width formed at predetermined positions on the front surface of the circularly polarized wave radiating module 11 in an X shape. The X groove 14 increase the surface area of the front surface of the circularly polarized wave radiating module 11 to reduce the size of the circularly polarized wave radiating module 11, for example, by a length corresponding to 0.3λ.

Further, as known in the art, the X groove 14 converts a frequency band into a wideband. Here, a wavelength λ of antenna is expressed by a following equation (1).

$$\lambda = \frac{C}{F} \tag{1}$$

where, λ is a wavelength of an antenna, c is a light velocity, and F is a frequency. Namely, as the wavelength of an antenna is increased, the size thereof is increased. Conversely, as the wavelength of the antenna is reduced, the size thereof is reduced. Meanwhile, as a frequency becomes higher, the wavelength is reduced. Conversely, as the frequency becomes lower, the wavelength is increased. Namely, as the size of the antenna is reduced, a frequency is increased. As the size of the antenna is increased, the frequency is reduced. Accordingly, the circularly polarized wave radiating module 11 reduces the size of the antenna by an X groove 14 but increases a real is radiating area. The circularly polarized wave radiating module having a really increased radiating area can efficiently radiate a circularly polarized wave. As the size of the antenna is reduced by the X groove 14, a frequency becomes higher increased. Accordingly, a bandwidth of a frequency of the antenna can be widely enlarged. Radiation efficiency of an antenna is increased by the X groove 14, and the stability of radiation characteristics of the circularly polarized wave can be secured according to expansion of a frequency bandwidth.

First Substrate 20 and Second Substrate 40

The first substrate 20 is provided between the first radiator 10 and the second radiating 30. Further, the second substrate 40 is provided between the second radiator 30 and a reflection plate 50. The first substrate 20 and the second substrate 40 support the first radiator 10 and the second radiator 30, respectively. Here, the first substrate 20 and the second substrate 40 are preferably configured by a frame retardant (FR) 4 substrate. The FR 4 substrate is a glass epoxy laminate, which has a general dielectric constant. As illustrated previously, $$\lambda = \frac{C}{F},$$

and a dielectric constant is in inverse proportion to a frequency. Accordingly, a frequency may be controlled by adjusting dielectric constants of the first substrate 20 and the second substrate 40 to design a wavelength and the size of an antenna of the first radiator 10 and the second radiator 30.

In the meantime, at least one engagement hole 22 and at least one engagement hole 42 are formed in the first substrate 20 and the second substrate 40, respectively, through which an insertion portion 52 formed on a reflection plate 50 penetrates. At least one through hole 24 and at least one through hole 44 are formed in the first substrate 20 and the second substrate 40, respectively, through with a power supply line L penetrates.

Second Radiator 30

The second radiator 30 includes a linearly polarized wave radiating module 31, at least one engagement hole 32, and at least one hole 34.

The linearly polarized wave radiating module 31 has a square band shape. The linearly polarized wave radiating module 31 radiates the linearly polarized wave in a positive (+) with a time period of 0.5λ pole and a negative (−) pole. The linearly polarized wave radiating module 31 further receives the circularly polarized wave radiated from the first radiator 10. Further, the linearly polarized wave radiating module 31 converts the received circularly polarized wave into a linearly polarized wave. Next, the linearly polarized wave radiating module 31 radiates the converted linearly polarized wave to an exterior. Here, the linearly polarized wave radiating module 31 is formed to be smaller than that of the second substrate 40. Accordingly, the linearly polarized wave radiating module 31 does not come in contact with the power supply line L penetrating the through the through holes 24 and 44 of the first substrate 20 and the second substrate 40. That is, the linearly polarized wave radiating module 31 is not connected to the first radiator 10 through a separate connection line. Namely, the linearly polarized wave radiating module 31 receives a circularly polarized wave radiated from the first radiator 10 in a wireless scheme, and converts it into a linearly polarized wave to generate a converted linearly polarized wave.

At least one engagement hole 32 is formed in the linearly polarized wave radiating module 31, thorough which the insertion portion 52 of the reflection plate 50 penetrates.

At least one hole 34 is provided at an inner side (center portion) of the radiating module 31 corresponding to the shape of the first radiator 10. As shown in FIGS. 3 and 4, upon viewing on plane, the first radiator 10 is provided at a position corresponding to the hole 34 of the second radiator 30. That is, the first radiator 10 and the second radiator 30 do not overlap with each other upon viewing on plane such that the linearly polarized wave radiated from the first radiator 10 and the circularly polarized wave radiated from the second radiator 30 do not affect each other. Consequently, it prevents loss of the linearly polarized wave and the circularly polarized wave generated from the first radiator 10 and the second radiator 30.

Reflection Plate 50

The reflection plate 50 includes a body 51, at least one insertion portions 52, and at least one through hole 54.

The body 51 is provided at a part or the whole of the rear surface of the second substrate 40. At least one insertion portion 52 is provided at a front surface of the body 51, which penetrates through the through which the engagement holes 22, 32, and 42. Furthermore, at least one through hole 54 is formed in the body 51, through which the power supply line L penetrates. The body 51 uniformly reflects the circularly polarized wave radiated from the first radiator 10 to an exterior. Moreover, the body 51 is electrically connected to the second radiator 30 through the insertion portion(s) 52, and generates the linearly polarized wave together with the second radiator 30. Here, the body 51 is made by metal material, preferably, aluminum material to efficiently reflect and radiate the linearly polarized wave and the circularly polarized wave.

In an embodiment, as shown in FIGS. 3 and 4, two insertion portions 52 may be provided in a diagonal direction. The area of the reflection plate 50 is increased by the insertion portions 52. Here, the insertion portions 52 are formed of the same metal of the reflection plate 50. The insertion portions 52 electrically connect the reflection plate 50, the second radiator 30, and the auxiliary radiator 60 to each other.

Auxiliary Radiator 60

At least two auxiliary radiator 60 can be provided on the first substrate 20. Preferably, two auxiliary radiators 60 are provided on the first substrate 20, as shown in FIG. 4. Each of the auxiliary radiators 60 includes a body 61 and at least one engagement hole 62. The size of the hole 34 of the second radiator 30 is the same as or larger than that of the first radiator 10. The width of the body 61 is the same as or smaller than a side portion of the second radiator 30. The body 61 is formed such that it is overlapped with the side portion of the second radiator 30, upon viewing on a plane. Further, the body 61 is spaced apart from the first radiator 10 by a predetermined distance. As a result, the auxiliary radiator 60 can generate the linearly polarized wave with the second radiator 30 without influence of the circularly polarized wave from the first radiator 10.

At least one engagement hole 62 is formed at one side of the body 61, through which one of the insertion portions 52 of the reflection plate 50 penetrates. Accordingly, the auxiliary radiator 60 is electrically connected to the second radiator 30 and the reflection plate 50 by the insertion portion 52 of the reflection plate 50. The auxiliary radiator 60 can generate the linearly polarized wave with the second radiator 30 and the reflection plate 50.

Here, by adjusting the size of the auxiliary radiator 60 and/or the spacing distance between the first radiator 10 and the auxiliary radiator 60, the resonant frequency of the first radiator 10 can be controlled. For example, as the length of the auxiliary radiator 60 is increased, the resonant frequency of the first radiator 10 is reduced according to coupling effect with the first radiator 10. Conversely, when the length of the auxiliary radiator 60 is reduced, the resonant frequency of the first radiator 10 is increased according to coupling effect with the first radiator 10. Meanwhile, as the width of the auxiliary radiator 60 is reduced, a spacing distance between the auxiliary radiator 60 and the first radiator 10 is increased and the resonant frequency of the first radiator 10 is reduced according to coupling effect with the first radiator 10. Conversely, as the width of the auxiliary radiator 60 is increased, the resonant frequency of the first radiator 10 is increased according to coupling effect of the first radiator 10. Consequently, resonant frequency characteristics of the first radiator 10 can be controlled by adjusting the size of the auxiliary radiator 60 and/or the spacing distance between the first radiator 10 and the auxiliary radiator 60.

In case of the antenna shown in FIG. 4, the size of one of the two auxiliary radiators 60 may be the same as or different from that of the other auxiliary radiator 60. The spacing distance between the first radiator 10 and one of the two auxiliary radiator 60 may be the same as or different from that between the first radiator 10 and the other auxiliary radiator 60.

Power Supply Line L

The power supply line L is connected to the signal receiving module 12 thorough the through holes 24, 44, and 54. Accordingly, the power supply line L receives an antenna signal from an external antenna signal generator and transfers it to the signal receiving module 12. Here, the power supply line L does not connect with the second radiator 30. The power supply line L is coated with an insulation material such that the antenna signal is transferred not to the reflection plate 50, the second substrate 40, and the first substrate 20 but to the signal receiving module 12.

An example of the operation of a patch antenna synchronously generating a linearly polarized wave and a circularly polarized wave will be described.

The first radiator 10 receives an external antenna signal through the power supply line L, converts the received antenna signal into a circularly polarized signal, and radiates the converted circularly polarized signal to an exterior.

Next, the reflection plate 50 reflects the circularly polarized wave radiated from the first radiator 10.

Subsequently, the second radiator 30 receives the circularly polarized wave radiated from the first radiator 10, converts the received circularly polarized wave into a linearly polarized wave, and radiates the converted linearly polarized wave to an exterior together with the reflection plate 50 and the auxiliary radiator 60.

Figure 5:
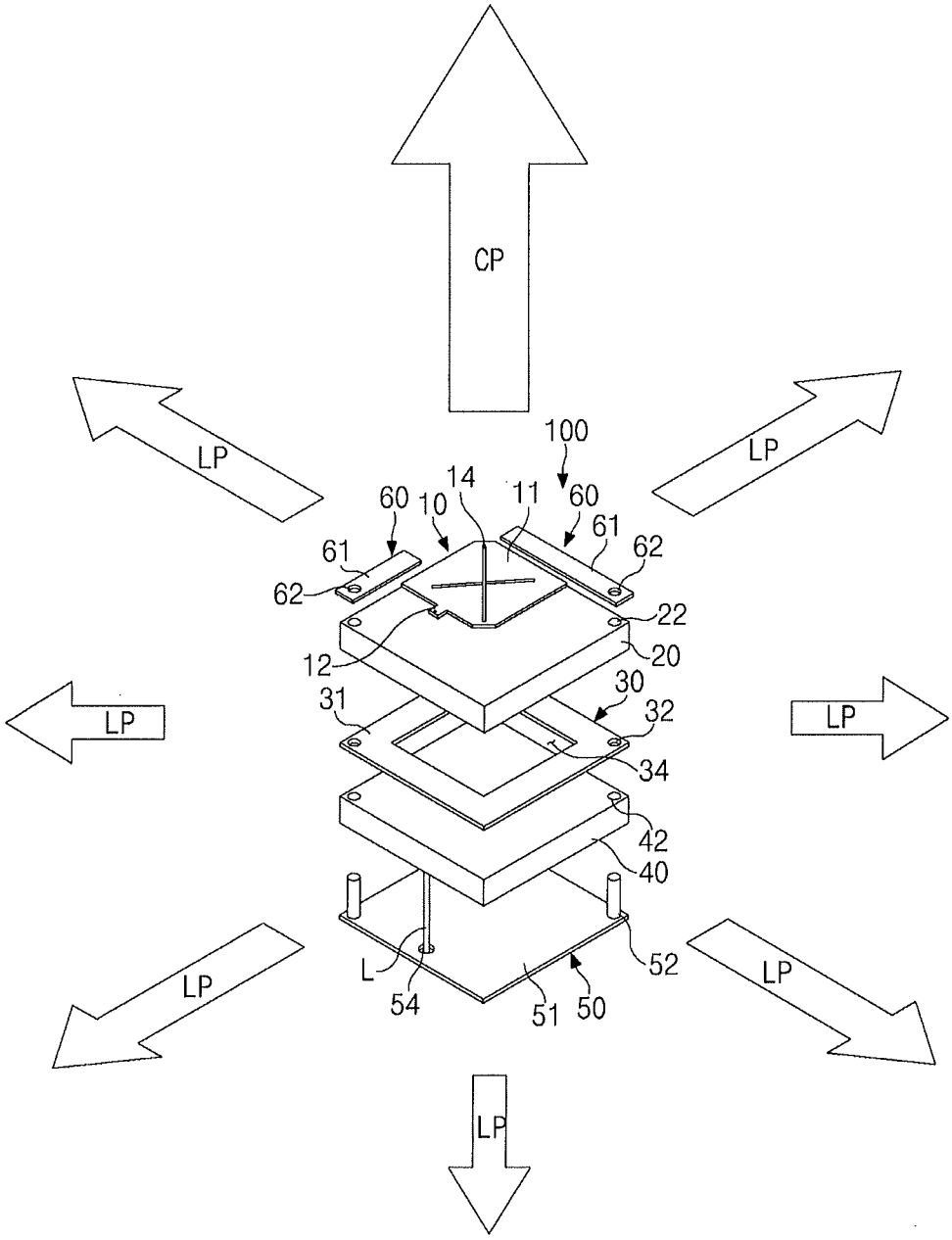
FIG. 5 is a perspective view illustrating a procedure generating a linearly polarized wave and a circularly polarized wave by a patch antenna synchronously generating a linearly polarized wave and a circularly polarized wave according to an embodiment of the present invention.

The patch antenna 100, as shown in FIG. 5, may generate waves including a circularly polarized (CP) wave generated by the first radiator 10, which rotates upward along the longitudinal direction of the first radiator 10 and in a string shape, a vertical linearly polarized (LP) wave having an electric field perpendicular to the ground, and a horizontal linearly polarized (LP) wave having an electric field horizontal to the ground.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A patch antenna synchronously generating a linearly polarized wave and a circularly polarized wave, comprising:

a first radiator radiating a circularly polarized wave with respect to an antenna signal;

a first substrate provided at a part or the whole of the rear surface of the first radiator;

a second radiator provided at a part or the whole of the rear surface of the first substrate and radiating a linearly polarized wave with respect to the antenna signal;

a second substrate provided at a part or the whole of the rear surface of the second radiator; and an auxillary radiator which is provided on a front surface of the first substrate is spaced apart from the first radiator by a predetermined distance.

2. The patch antenna of claim 1, further comprising a reflection plate reflecting a circularly polarized wave radiated from the first radiator and radiating a linearly polarized wave.

3. The patch antenna of claim 2, wherein the first substrate, the second radiator, and the second substrate, respectively, are provided with at least one engagement hole formed therein and the reflection plate is provided with at least one insertion portion formed on the front surface thereof such that the insertion portion or portions can be inserted to the engagement holes.

4. The patch antenna of claim 2, wherein the second radiator receives a circularly polarized wave radiated from the first radiator, converts the received circularly polarized wave into a linearly polarized wave, and radiates the converted linearly polarized wave.

5. The patch antenna of claim 1, wherein the first radiator and the second radiator are positioned so as not to overlap with each other when viewed on a plane.

6. The patch antenna of claim 5, wherein the second radiator has a hole in the center thereof, and the first radiator is positioned so as to be within the center hole of the second radiator when viewed on a plane.

7. The patch antenna of claim 1, wherein the auxiliary radiator is provided at a position on the front surface of the first substrate such that the auxiliary radiator is overlapped with the second radiator when viewed on a plane.

8. The patch antenna of claim 7, wherein width of the auxiliary radiator is the same as or smaller than that of an outer end portion of the second radiator.

9. The patch antenna of claim 2, wherein further comprising a power supply line which is electrically connected to the first radiator without being electrically connected to the reflection plate, the second substrate, and the first substrate.

10. The patch antenna of claim 1, wherein the first radiator includes a circularly polarized wave radiating module, a signal receiving module provided at a side of the circularly polarized wave radiating module, and an X groove formed on a part of the front surface of the circularly polarized wave radiating module.

11. The patch antenna of claim 10, wherein further comprising a power supply line which is electrically connected to the signal receiving module of the first radiator.

12. A method for synchronously generating a linearly polarized wave and a circularly polarized wave by a patch antenna, comprising:

radiating a circularly polarized wave with respect to an antenna signal by a first radiator provided at a part or the whole of the front surface of a first substrate;

radiating a linearly polarized wave with respect to the antenna signal by a second radiator provided at a part or the whole of the front surface of a second substrate;

generating a linearly polarized wave by an auxiliary radiator provided at a part or the whole of the front surface of the first substrate.

13. The method of claim 12, further comprising:

reflecting a circularly polarized wave radiated from the first radiator by a reflection plate provided at a part or the whole of the rear surface of the second substrate; and radiating the linearly polarized wave by the reflection plate.

14. The method of claim 12, wherein the second radiator receives the circularly polarized wave radiated from the first radiator, converts the received circularly polarized wave into a linearly polarized wave, and radiates the converted linearly polarized wave by the reflection plate.

* * * * *